US012559947B2

(12) United States Patent
Herman

(10) Patent No.: US 12,559,947 B2
(45) Date of Patent: Feb. 24, 2026

(54) CABLE RAILING FITTING

(71) Applicant: Joel Duane Herman, Thurmont, MD (US)

(72) Inventor: Joel Duane Herman, Thurmont, MD (US)

( * ) Notice: Subject to any disclaimer, the term of this patent is extended or adjusted under 35 U.S.C. 154(b) by 403 days.

(21) Appl. No.: 17/967,182

(22) Filed: Oct. 17, 2022

(65) Prior Publication Data

US 2023/0123977 A1 Apr. 20, 2023

Related U.S. Application Data

(60) Provisional application No. 63/288,029, filed on Dec. 10, 2021, provisional application No. 63/257,923, filed on Oct. 20, 2021.

(51) Int. Cl.
*E04F 11/18* (2006.01)

(52) U.S. Cl.
CPC ..... *E04F 11/1859* (2013.01)

(58) Field of Classification Search
CPC ..... E04F 11/1817; E04F 11/1859; E04F 2011/1819; E04F 2011/1831; E04F 2011/1882; E04H 17/02; E04H 17/04; E04H 17/06; E04H 17/08; E04H 17/12; E04H 17/124; E04H 17/127; E04H 17/131; F16G 11/12
See application file for complete search history.

(56) References Cited

U.S. PATENT DOCUMENTS

| | | | | |
|---|---|---|---|---|
| 211,139 | A * | 1/1879 | Erb | E04H 17/131 256/47 |
| 553,466 | A * | 1/1896 | Holzwarth | F16G 11/12 256/40 |
| 576,958 | A * | 2/1897 | Field | F16G 11/12 267/71 |
| 9,145,705 | B2 * | 9/2015 | Herman | E04H 17/009 |
| 9,249,577 | B2 * | 2/2016 | Ross | F16G 11/04 |
| 10,221,522 | B1 * | 3/2019 | Henderson | E04F 11/1859 |
| 11,629,502 | B1 * | 4/2023 | Smitchko | E04F 11/1859 256/47 |
| 11,668,096 | B2 * | 6/2023 | Li | E04F 11/1859 256/21 |

(Continued)

FOREIGN PATENT DOCUMENTS

| | | | | |
|---|---|---|---|---|
| CH | 662624 | A5 * | 10/1987 | E04H 17/131 |
| DE | 3436077 | A1 * | 4/1986 | |

(Continued)

*Primary Examiner* — Jonathan P Masinick
(74) *Attorney, Agent, or Firm* — Leveque IP Law, P.C.

(57) ABSTRACT

Methods and structures for securing a tensioned cable to a support post in a cable railing system. A threaded insert is inserted into the support post and a decorative cover placed over the support post. A cable-lock is partially screwed into the threaded insert and an end of the cable inserted into the cable-lock. The cable-lock is further screwed into the threaded insert to tension the cable. A further embodiment provides that a tensioning cartridge is loaded and placed in a support post, a decorative cover placed over the support post, an end of the cable inserted into a push-to-lock fitting of the tensioning cartridge, and a sprint-lock mechanism of the tensioning cartridge released to tension the cable.

2 Claims, 14 Drawing Sheets

(56) References Cited

U.S. PATENT DOCUMENTS

| | | | | |
|---|---|---|---|---|
| 2009/0249738 | A1* | 10/2009 | Brereton | F16B 13/0808 52/741.2 |
| 2011/0084180 | A1* | 4/2011 | Toimil | F16G 11/106 248/74.2 |
| 2024/0110380 | A1* | 4/2024 | Schneider | E04F 11/1859 |
| 2024/0110381 | A1* | 4/2024 | Schneider | E04F 11/1859 |
| 2024/0110382 | A1* | 4/2024 | Schneider | F16G 11/106 |
| 2024/0110383 | A1* | 4/2024 | Schneider | E04F 11/1859 |
| 2024/0110384 | A1* | 4/2024 | Schneider | E04F 11/1859 |
| 2024/0110385 | A1* | 4/2024 | Schneider | E04F 11/1859 |
| 2024/0368913 | A1* | 11/2024 | Miller | E04H 17/124 |

FOREIGN PATENT DOCUMENTS

| | | | | | |
|---|---|---|---|---|---|
| FR | 3000531 | A1 | * | 7/2014 | F16G 11/12 |
| JP | 2001275241 | A | * | 10/2001 | |
| JP | 2011002059 | A | * | 1/2011 | |
| KR | 20110120535 | A | * | 11/2011 | E04H 17/08 |

* cited by examiner

1100

1100

CABLE RAILING FITTING

RELATED APPLICATIONS

This application claims the benefit of provisional application Ser. No. 63/257,923 filed Oct. 20, 2021 and titled 'CABLE RAILING FITTING', the entire content of which is hereby incorporated by reference herein. This application also claims the benefit of provisional application Ser. No. 63/288,029 filed Dec. 10, 2021 and titled 'CABLE RAILING FITTING', the entire content of which is hereby incorporated by reference herein.

BACKGROUND

A cable railing commonly includes a number of cables or rods tensioned between support posts. A cable railing may be used, for example, to provide a safety barrier between a walking area, such as a staircase, balcony or walkway, and drop-off.

BRIEF DESCRIPTION OF THE DRAWINGS

The accompanying drawings provide visual representations which will be used to more fully describe various representative embodiments and can be used by those skilled in the art to better understand the representative embodiments disclosed and their inherent advantages. In these drawings, like reference numerals identify corresponding or analogous elements.

DETAILED DESCRIPTION

Figure 1:
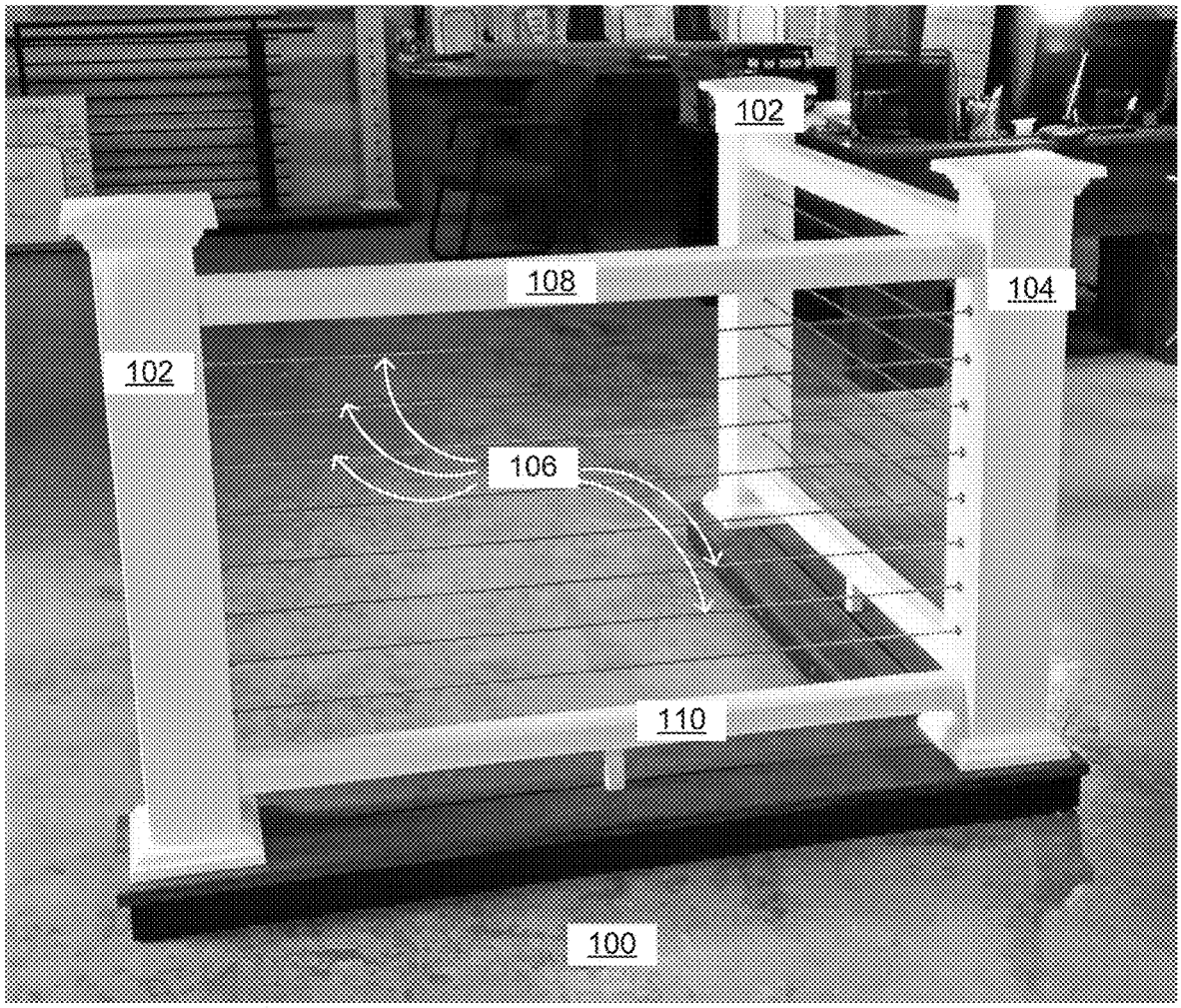
FIG. 1 shows an example section of a cable railing, in accordance with an embodiment of the present disclosure.

The various apparatus and devices described herein provide mechanisms for securing a cable in tension between two support members, such as posts.

While this present disclosure is susceptible of embodiment in many different forms, there is shown in the drawings and will herein be described in detail specific embodiments, with the understanding that the embodiments shown and described herein should be considered as providing examples of the principles of the present disclosure and are not intended to limit the present disclosure to the specific embodiments shown and described. In the description below, like reference numerals are used to describe the same, similar or corresponding parts in the several views of the drawings. For simplicity and clarity of illustration, reference numerals may be repeated among the figures to indicate corresponding or analogous elements.

FIG. 1 shows an example section of cable railing 100, in accordance with various representative embodiments. The cable railing includes support members (posts) 102 and 104. In the embodiment shown, the support members are vertical posts, but other configurations may be used. Cables 106 are tensioned between the posts. Posts 102 are end posts with cable attached to one side only, while post 104 is a corner post with cables attached to two adjacent sides. Additional posts, such an intermediate post, with cables attached to two opposite sides (or indeed more than two sides) may also be provided. Top rail 108 and/or bottom rail 110 may also be provided and may assist in preventing the posts from being pulled together in response to the tension in cables 106.

The present disclosure relates to mechanisms for attaching the cable to the posts and tensioning the cables.

In one embodiment, posts 102 and 104 each include an inner support post, to which the cables are attached and an outer cover, such as a decorative cover, that at least partially encloses the post. The inner support post may be constructed of any material with sufficient strength to resist the tension in the cables. The outer cover may be plastic or some other material. In one embodiment, the outer cover is a section of extruded tubing having a substantially square cross-section and topped by a post cap. In FIG. 1, the outer cover is visible but the inner support post is not.

In one embodiment, the inner support post comprises a wooden post.

In a further embodiment, the inner support post comprises a metal post.

While the combination of an inner post with an outer cover has some advantages, at least one potential disadvantage, i.e., attaching the cable to inner post, presents challenges to installers.

The present disclosure advantageously provides mechanisms for attaching, and tensioning, cables to the inner support post after the outer cover has been installed.

FIGS. 2-7 show horizontal cross-sections through cable railing posts, in accordance with embodiments of the present disclosure.

Figure 2:
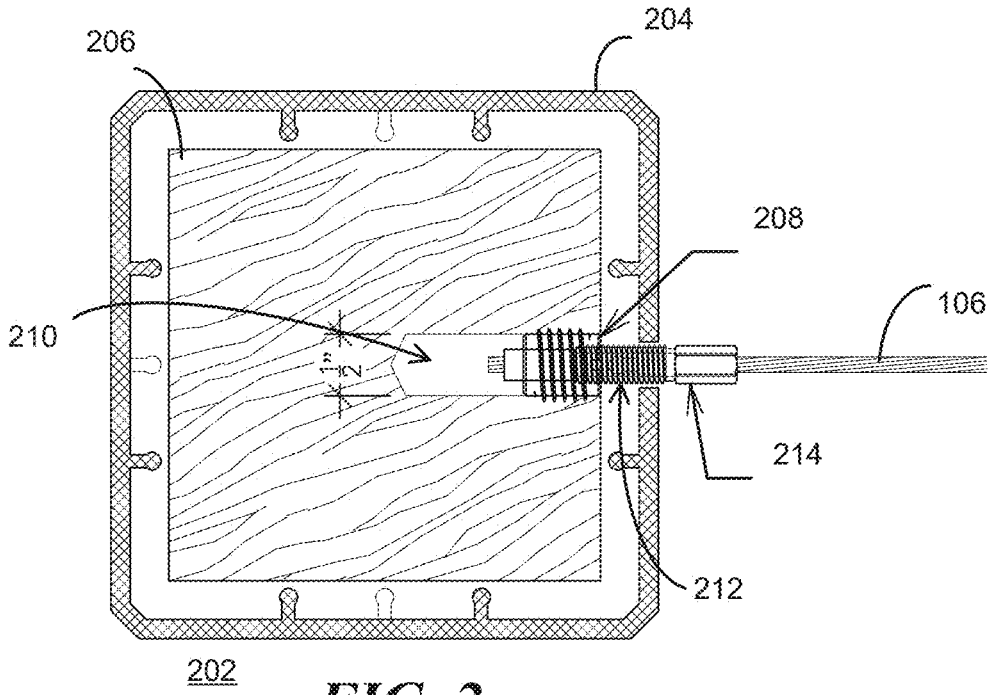
FIGS. 2-7 show horizontal cross-sections through cable railing posts, in accordance with embodiments of the present disclosure.

FIG. 2 shows a horizontal cross-section through a cable railing post 202, in accordance with various representative embodiments. In the embodiment shown, cable railing post 202 includes outer cover 204 and inner support post 206. In the example shown, threaded insert 208 is screwed into hole 210 in inner support post 206 before outer cover 204 is installed. The hole may extend part way through inner support post 206, as shown, or all of the way through. In the example shown, hole 210 has a ½-inch diameter, but other sizes may be used. Prior to attaching cable 106 to inner support post 206, cable-lock (or cable lock stud) 212 is partially screwed into threaded insert 208. In one embodiment, cable-lock stud 212 is a Push-Lock® Stud by Ultra-Tec. After outer cover 204 has been installed (for example, by placing outer cover 204 over inner support post 206), an end of cable 106 is inserted into cable-lock stud 212. This action locks cable 106 into cable-lock stud 212 and prevents it from being pulled out under normal tensioning loads. After the other end of cable 106 is secured, cable 106 may be tensioned by turning machine-bolt tensioner 214 to screw cable-lock stud 212 further into threaded insert 208, as shown in FIG. 3.

Figure 3:
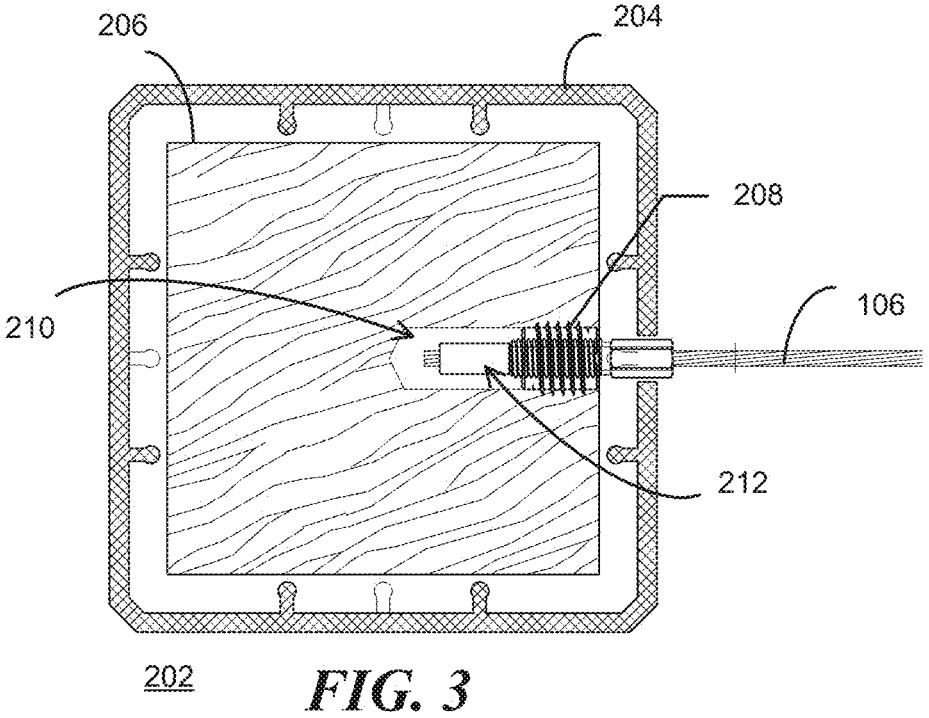

In FIG. 3, cable-lock stud 212 has been screwed further into hole 210. This increases the tension in cable 106.

A cable may be tensioned at one or both ends. When only one end is tensioned, the other end is attached to a post (or other structure).

Figure 4:
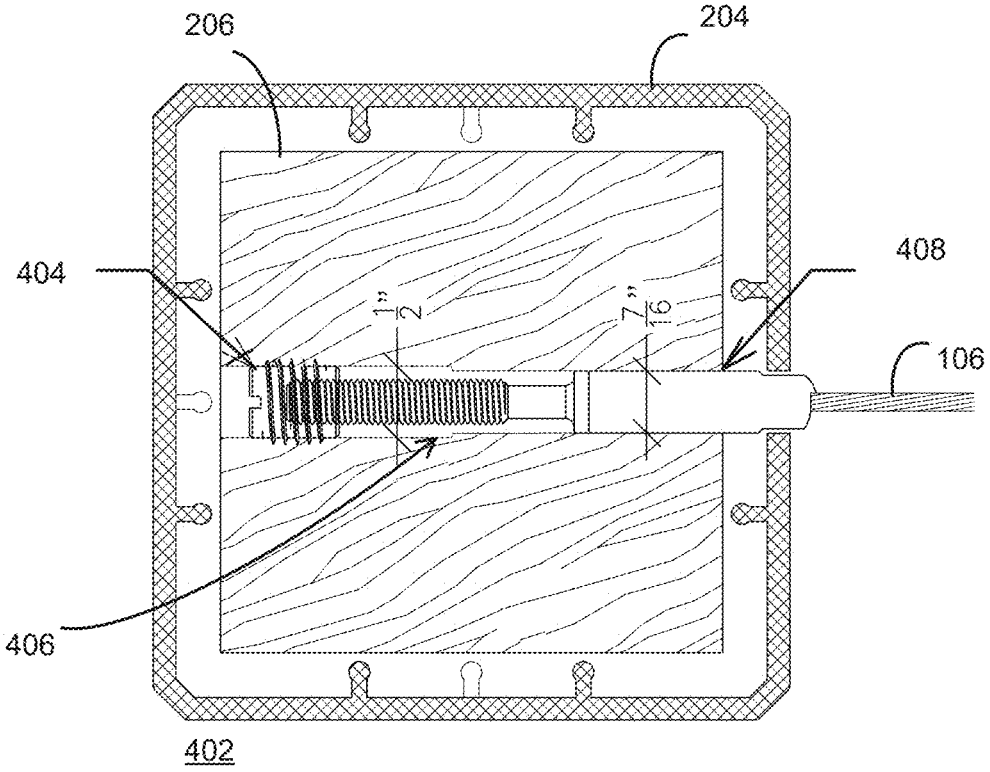

FIG. 4 is a horizontal cross-section through cable railing post 402, in accordance with an embodiment of the present disclosure. In this embodiment, cable railing post 402 includes outer cover 204 and inner support post 206. Threaded insert 404 is screwed into hole 406 in inner support post 206 before outer cover 204 is installed. Threaded insert 404 may comprise a short cylinder having an outside thread for engaging the post and an inside thread for engaging cable-lock stud 408. The hole may extend all of the way through the support post, as shown, or only part way through. The hole may be sized to receive the threaded insert at one end (e.g., ½ inch diameter) and cable-lock stud 408 at the other (e.g., 7/16 inch diameter). After outer cover 204 has been installed (for example, by placing outer cover 204 over inner support post 206), cable-lock stud 408 is passed through outer cover 204 and screwed into threaded insert 404. Cable 106 is then inserted into cable-lock stud 408. This action locks cable 106 into cable-lock stud 408 and prevents cable 106 from being pulled out under normal tensioning loads. The other end of cable 106 may then be tensioned.

Figure 5:
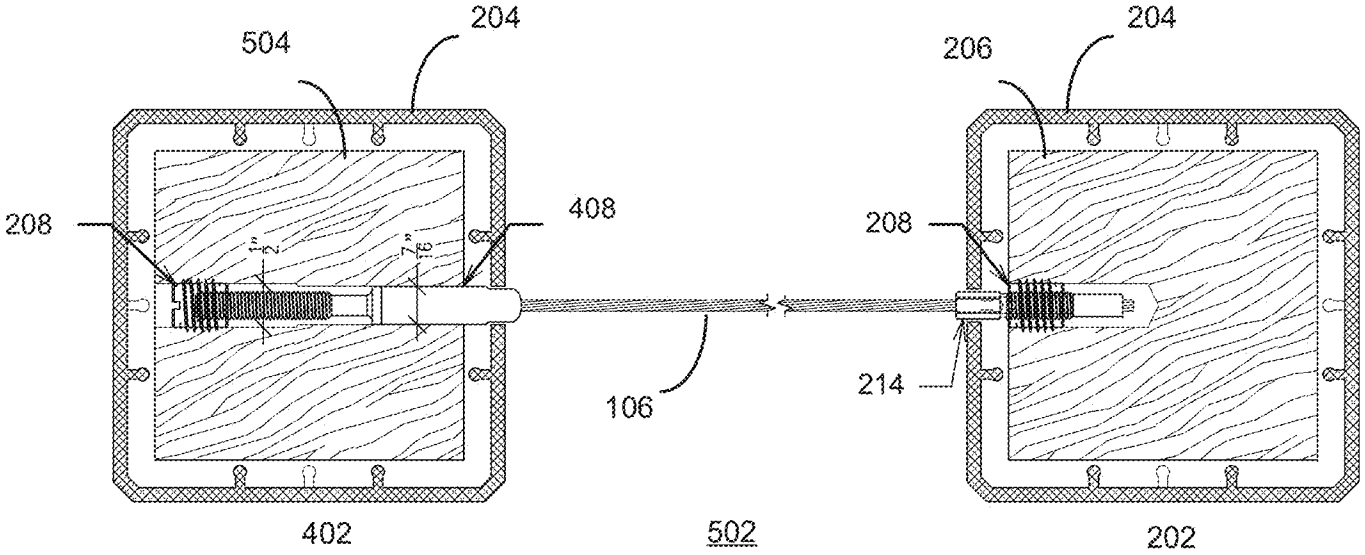

FIG. 5 is a horizontal cross-section through cable railing 502, in accordance with an embodiment of the present disclosure. Cable railing 502 includes tensioning post 202 and non-tensioning post 402. Cable 106 is attached at one end to inner support post 206 of tensioning post 202 and at the other end to inner support post 504 non-tensioning post 402. Once cable 106 is assembled, machine-bolt tensioner 214 of tensioning post 202 may be turned to increase the tension in cable 106.

Figure 6:
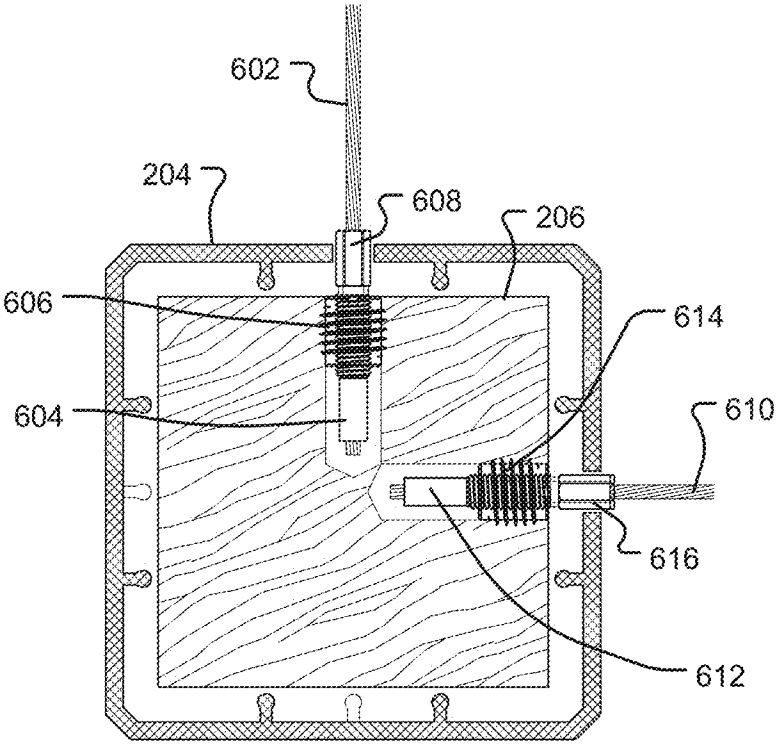

FIG. 6 is a horizontal cross-section through corner support post 600 of a cable railing system, in accordance with an embodiment of the present disclosure. Corner support post 600 includes outer cover 204 and inner support post 206. Cable 602 is inserted in cable-lock stud 604 that, in turn, is screwed into threaded insert 606. Threaded insert 606 is screwed into inner support post 206 prior to installation of outer cover 204. Cable 602 is tensioned using machine-bolt tensioner 608. Similarly, cable 610 is inserted in cable-lock stud 612 that, in turn, is screwed into threaded insert 614. Threaded insert 614 is screwed into inner support post 206 prior to installation of outer cover 204. Cable 610 is tensioned using machine-bolt tensioner 616. Corner support post 600 provides non-tensioning attachments for cables on two adjacent sides.

Figure 7:
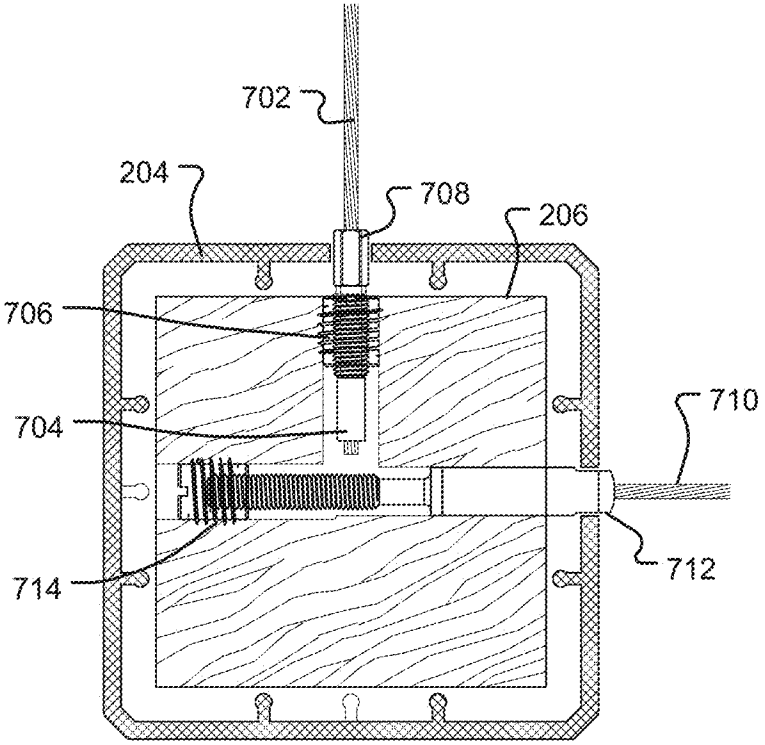

FIG. 7 is a horizontal cross-section through a corner support post 700 of a cable railing system, in accordance with an embodiment of the present disclosure. Corner support post 700 includes outer cover 204 and inner support post 206. Cable 702 is inserted in cable-lock stud 704 that, in turn, is screwed into threaded insert 706. Threaded insert 706 is screwed into inner support post 206 prior to installation of outer cover 204. Cable 702 is tensioned using machine-bolt tensioner 708. Similarly, cable 710 is inserted in cable-lock stud 712 that, in turn, is screwed into threaded insert 714. Threaded insert 714 is screwed into inner support post 206 prior to installation of outer cover 204. Cable 710 is tensioned using machine-bolt tensioner 716. Corner support post 700 provides non-tensioning attachments for cables on one side and tensioning attachments for cables on an adjacent side.

Figure 8:
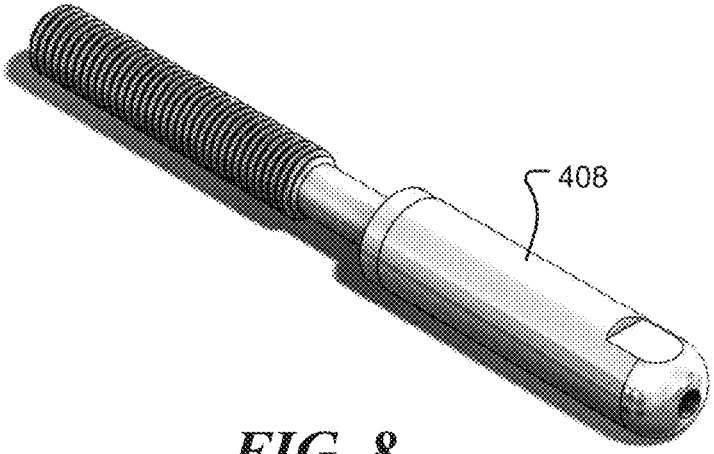
FIG. 8 is a perspective view of a cable-lock stud, in accordance with an embodiment of the present disclosure.

FIG. 8 is a perspective view of cable-lock stud 408, in accordance with an embodiment of the present disclosure.

Figure 9:
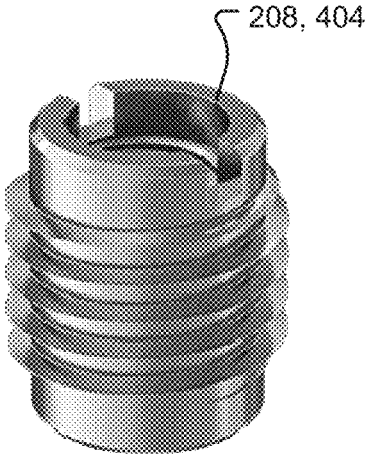
FIG. 9 is a perspective view of a threaded insert, in accordance with an embodiment of the present disclosure.

FIG. 9 is a perspective view of threaded insert 208, 404, in accordance with an embodiment of the present disclosure.

Figure 10:
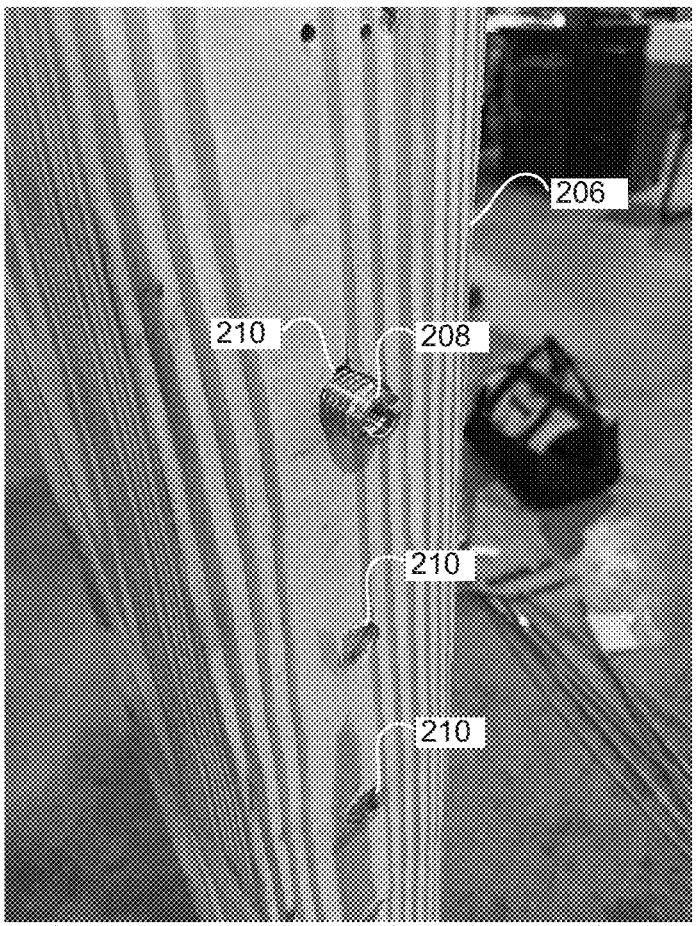
FIG. 10 shows an inner support post, in accordance with an embodiment of the present disclosure.

FIG. 10 shows inner support post 206 with holes 210 down one side in accordance with an embodiment of the present disclosure. Threaded inserts, such as threaded insert 208, are screwed into the holes before the outer cover is installed.

Figure 11:
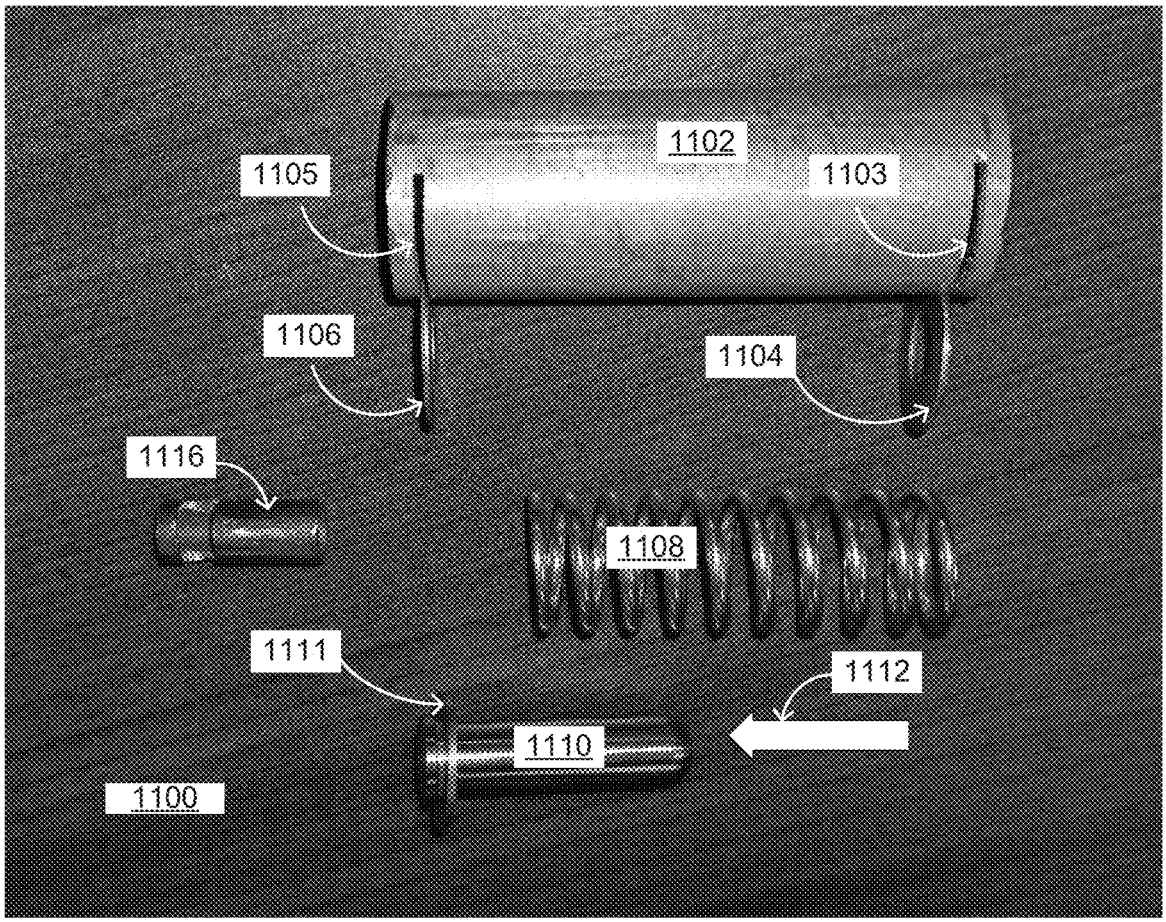
FIG. 11 shows components of a tensioning cartridge, in accordance with an embodiment of the present disclosure.

FIG. 11 shows components of tensioning cartridge 1100 in accordance with an embodiment of the present disclosure. Tensioning cartridge 1100 includes cylindrical tube 1102 having slots 1103 and 1105 to receive washers 1104 and 1106, respectively. When positioned in slots 1103, 1105, washers 1104, 1106 partially close the end regions of tube 1102. Tensioning cartridge 1100 also includes spring 1108 and cable-lock 1110. Cable 1206 may be inserted into cable-lock 1110 in the direction of arrow 1112. Lock pin 1116 is used to hold spring 1108 in compression when tensioning cartridge 1100 is assembled, as will be discussed below.

Figure 12:
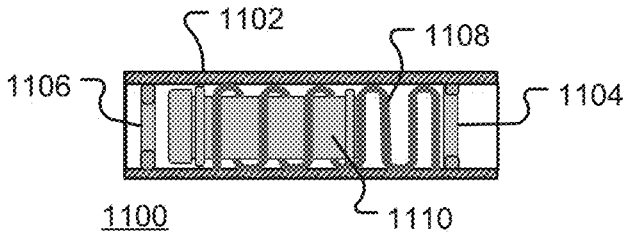
FIGS. 12-14 are diagrammatic representations of a tensioning cartridge, in accordance with embodiments of the present disclosure.

FIG. 12 shows a tensioning cartridge 1100, in accordance with an embodiment of the present disclosure. Tensioning cartridge 1100 is shown prior to compression. Spring 1108 and cable-lock 1110 are placed inside cylindrical tube 1102 and the end regions of tube 1102 are partially closed by washers 1104, 1106. In a further embodiment, one of washers 1104, 1106 may be pre-installed in tube 1102, since access at both ends is not required.

Figure 13:
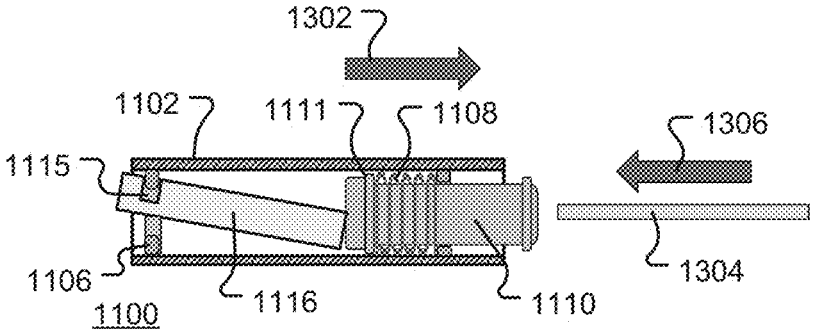

FIG. 13 shows a tensioning cartridge 1100, in accordance with an embodiment of the present disclosure. Tensioning cartridge 1100 is shown after compression of spring 1108. In this embodiment, spring 1108 is compressed by pushing lock pin 1116 against cable-lock 1110 in the direction of arrow 1302. A flange 1111 of cable-lock 1110, in turn, compresses spring 1108. Once spring 1108 is compressed, lock pin 1116 is offset such that slot 1115 in lock pin 1116 engages washer 1106 and prevents lock pin 1116 from being pushed out of cylindrical tube 1102. Spring 1108 may be compressed before or after tensioning cartridge 1100 is installed in a post. When an outer cover is used, spring 1108 is compressed prior to installation of the outer cover. It will be apparent to those of ordinary skill in the art that other alternative, equivalent mechanisms may be used to hold the spring in compression. Once tensioning cartridge 1100 is installed in a post, an end region of cable 1304 is pushed into cable-lock 1110 in the direction of arrow 1306 to couple cable 1304 to tensioning cartridge 1100.

Figure 14:
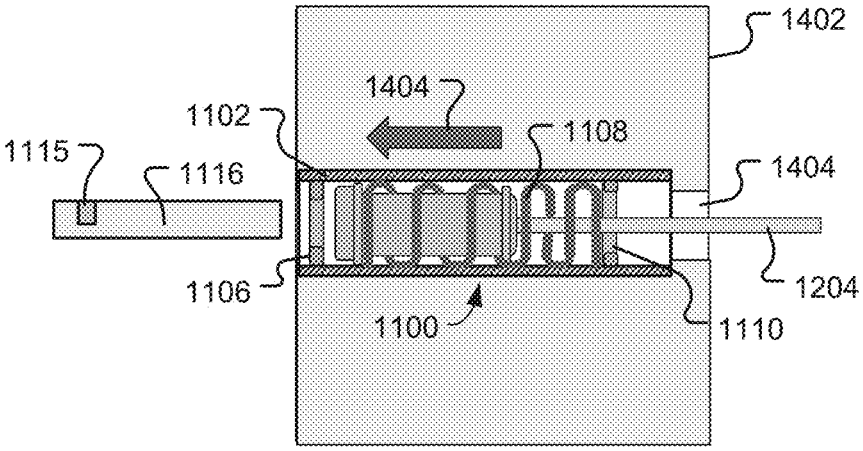

FIG. 14 shows tensioning cartridge 1100, in accordance with an embodiment of the present disclosure. Tensioning cartridge 1100 is shown after installation in support post 1402. Tensioning cartridge 1100 is inserted in hole 1404 in support post 1402 at position where cable 1204 is to be attached. In this embodiment, the cable end of hole 1404 is narrower than tensioning cartridge 1100 to prevent tensioning cartridge 1100 from being pulled through support post 1402 when cable 1204 is tensioned. Lock pin 1116 is dislodged and pushed from tensioning cartridge 1100 and cable-lock 1110 is moved in the direction 1405, thereby tensioning cable 1204.

Figure 15:
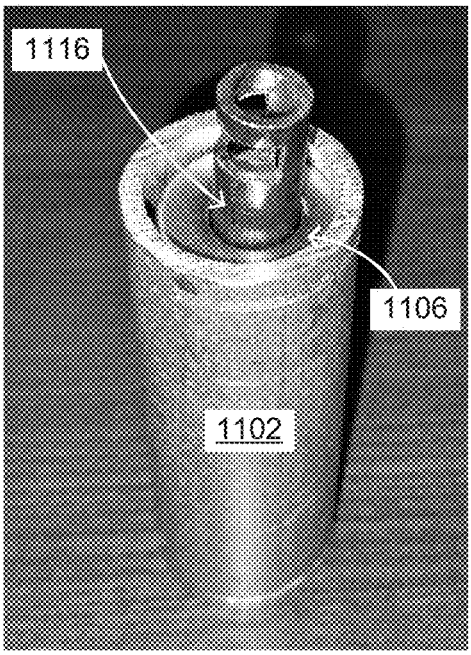
FIGS. 15-16 show images of a tensioning cartridge, in accordance with embodiments of the present disclosure.

FIG. 15 shows a tensioning cartridge 1100 in accordance with an embodiment of the present disclosure. Cartridge 1100 has a flange formed by washer 1106. Flange may be formed by other means. Lock pin 1116 is inserted into tensioning cartridge 1100 and may be used to compress the spring within tensioning cartridge 1100, as described above.

Figure 16:
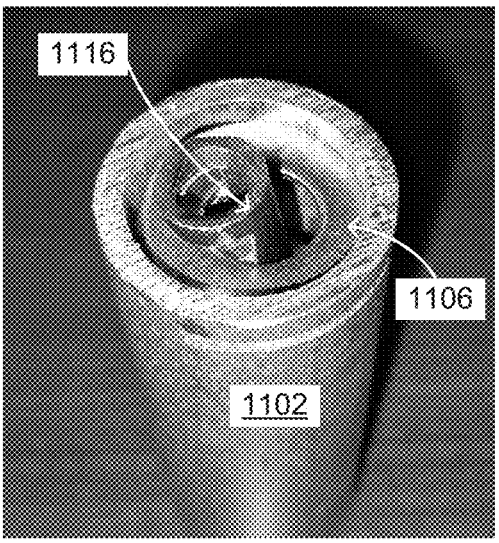

FIG. 16 shows a tensioning cartridge 1100 in accordance with an embodiment of the present disclosure. The spring has been compressed and lock pin 1116 has engaged the flange formed by washer 1106. This maintains the spring in compression, as described above.

Figure 17:
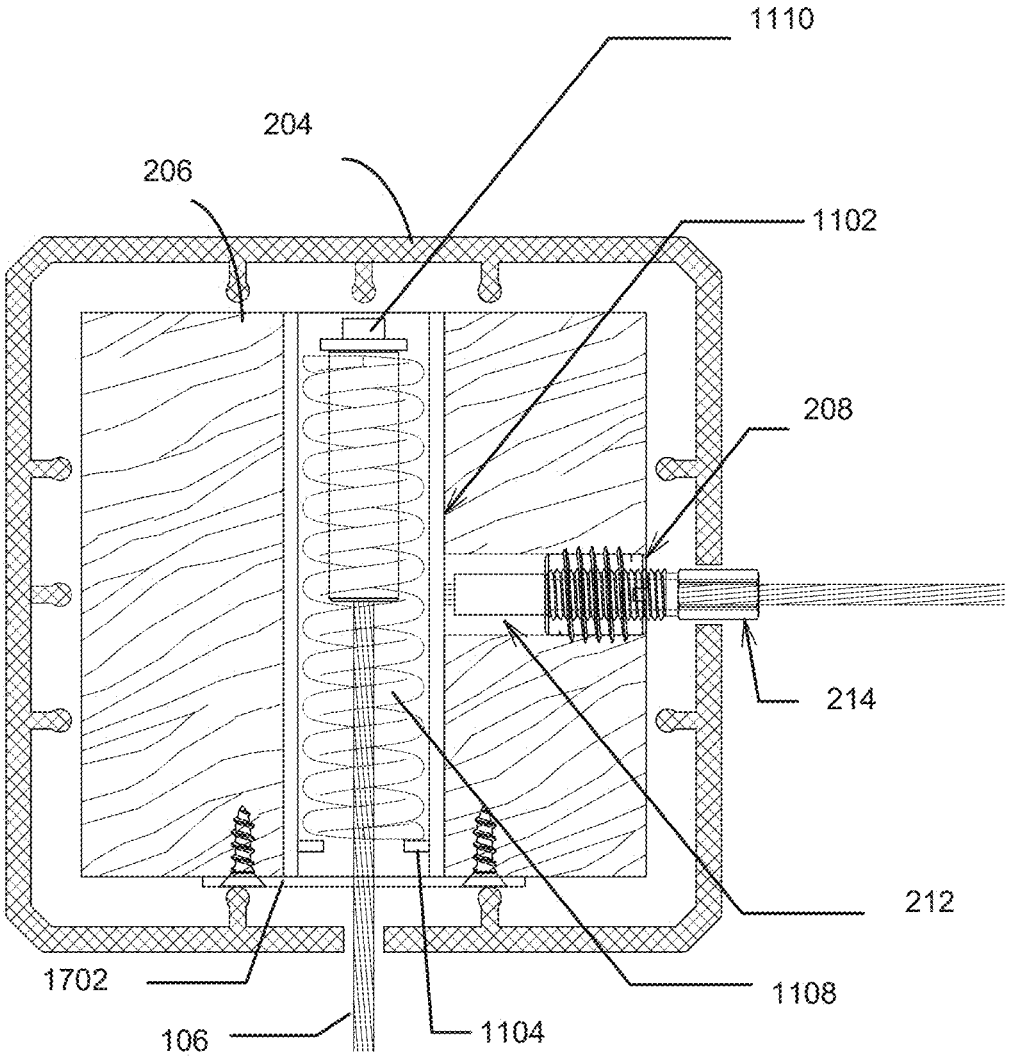
FIG. 17 shows a horizontal cross-section through a corner cable railing post, in accordance with an embodiment of the present disclosure.

FIG. 17 shows a horizontal cross-section through a corner cable railing post (such as post 104 in FIG. 1), in accordance with an embodiment of the present disclosure. The post includes outer cover 204 and inner support post 206. The post also includes a tensioning cartridge comprising cylindrical tube 1102 with flange 1702, spring 1108 and cable-lock 1110. Flange 1702 is used to secure cylindrical tube 1102 in a hole in support post 206 using screws. Cylindrical tube 1102 may be secured by other means, as will be apparent to those of ordinary skill in the art. The tensioning cartridge is used to tension a cable in a first direction. In addition, the post includes threaded insert 208, cable-lock stud 212 and machine-bolt tensioner 214 that are used to tension a cable in a second direction perpendicular to the first direction.

In addition, other mechanisms may be used to hold the spring in compression during installation and to release the spring after a cable has been inserted into the cable-lock.

In accordance with an embodiment of the disclosure, a cable railing may be installed as follows:

- Mark locations of cables on wood post(s) and drill completely through with ¼" bit (Larger bits may be used, but no larger than ⅜").
- Use wood hole saw bit to drill 1" diameter hole from outside of post 85% deep into wood post, centered on previous hole (e.g., 85% of 4"×4" post is about 3⅜").
- Bore out each hole with 1" Forstner bit to clean hole and inside post wall; remove debris.
- Insert preassembled fitting until rim of tube is flush against the inside post wall (ensure the spring side is facing inside of post (cable side) and the pull-lock side is facing the outside of the post; a soft mallet may be required for full insertion).
- After all assemblies are properly placed, push rear (outside post side) of pull lock with set pin; slide groove of pin to lock onto the wall of rear stopper; this will compress the spring and charge the appliance for tensioning.
- Carefully place post sleeve or cladding over the post until it securely meets the mounting surface (avoid hitting the set pins as they may release if struck).
- Slide a grommet or CS tube onto each cable; insert cables into pull lock from inside of post until the locking jaws firmly grip (do not pull the cable back to check for grip as this may also release the pins).
- When all cables are inserted at both ends, lower the release rod between the outside of the wood post and the inside wall of the sleeve; free each pin by tapping them in order from top to bottom; this will trigger each spring to expand and push the pull lock to its maximum distance, thus creating even more tension (pins will fall to the bottom being trapped inside of the cladding; they can remain there or be removed with a magnet).
- Replace post top cap and perform any necessary cleanup and finishing.

Figure 18B:
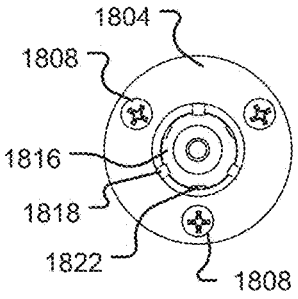
FIG. 18 shows views of a cable railing support post and a tensioning cartridge, in accordance with various representative embodiments.
Figure 18A:
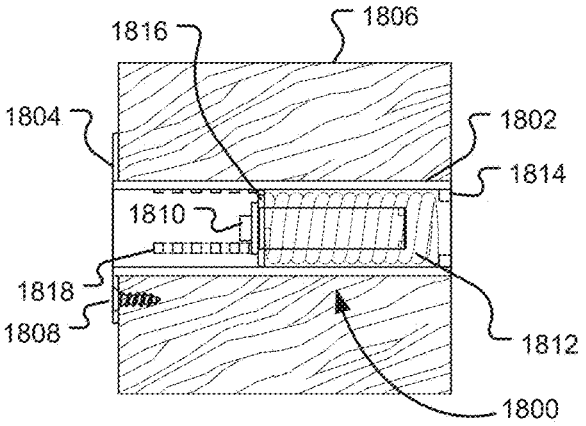
Figure 18C:
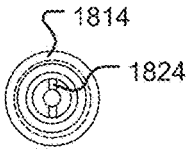

FIG. 18 shows views of support post 1806 and tensioning cartridge 1800, in accordance with an embodiment of the present disclosure. Tensioning cartridge 1800 has a rotate-to-lock/rotate-to-release mechanism, whereby a cable tensioning spring is pre-compressed and "locked" in place before assembly and then "released", by rotating, after a cable has been attached. View "A" shows support post 1806 and tensioning cartridge 1800 prior to attachment of a cable. Referring to view "A", tube 1802 with first tube flange 1804 is located in hole in support post 1806. First tube flange 1804 prevents tube 1802 from being pulled through support post 1806, and may be secured via screws 1808. Push-to-lock fitting 1810 is located in the tube 1802. Spring 1812 is located between second tube flange 1814 and a flange 1816 of push-to-lock fitting 1810. Flange 1816 holds spring 1812 in compression. Spring 1812 presses flange 1816 against one or more keys of keyways 1818 and the keys prevent push-to-lock fitting 1810 from being pushed along tube 1802.

View "B" shows a left view of tensioning cartridge 1800 showing first tube flange 1804 and flange 1816 of push-to-lock fitting 1810. Keys or protrusions of keyway 1818 engage flange 1816 and prevent flange 1816 from being pushed out of tube 1802 by compressed spring 1812. Notches 1822 in flange 1816 are rotated to misalign with the keyway protrusions.

View "C" is a view a left view of tensioning cartridge 1800 showing second tube flange 1814 and an end of push-to-lock fitting 1810. This view shows slot 1824 in the end of push-to-lock fitting 1810. Slot 1824 is sized to engage a tool that is used to rotate push-to-lock fitting 1810 for locking or releasing. As will be discussed below, push-to-lock fitting 1810 may be rotated about its longitudinal axis so that notches 1822 in flange 1816 align with the protrusions in keyway 1818. This frees push-to-lock fitting 1810 and allows spring 1812 to decompress.

Although three keyways and three notches are shown in FIG. 18, any number may be used. For example, 2 or 4 could be used.

Figure 19:
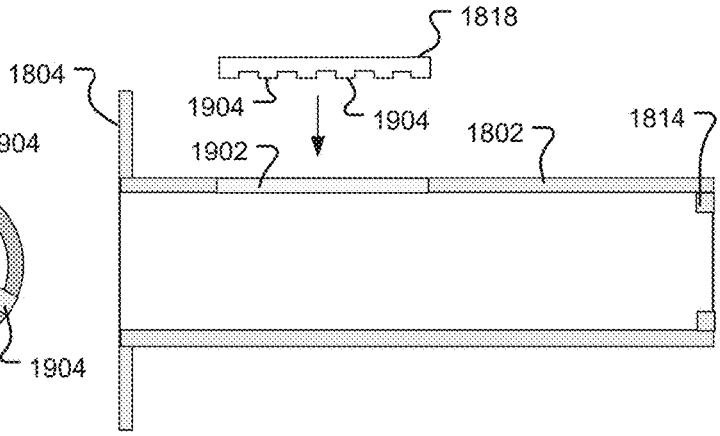
FIG. 19 is a cross-sectional view of a tube and keyway, in accordance with various representative embodiments.

FIG. 19 is a cross-sectional view of tube 1802 and keyway 1818, in accordance with an embodiment of the present disclosure. Keyway 1818 is sized to fit in slot 1902 in tube 1802. Keyway 1818 includes one or more protrusions or keys 1904. Second tube flange 1814 may be any constriction in tube 1802, such as indentations or a rolled edge, or an attached ring.

Figure 20:
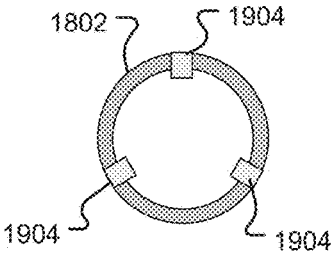
FIG. 20 is an end view of a tube and keyways, in accordance with various representative embodiments.

FIG. 20 is an end view of tube 1802 and keyways 1818, in accordance with various representative embodiments. In this embodiment shown, three keyways 1818 are equally spaced around the circumference of tube 1802. The protrusions or keys 1904 of the keyway 1818 extend into the interior of tube 1802.

Figure 21:
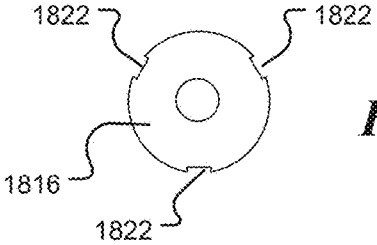
FIG. 21 is an end view of a flange of a push-to-lock fitting, in accordance with various representative embodiments.

FIG. 21 is an end view of flange 1816 of push-to-lock fitting 1810, in accordance with an embodiment of the present disclosure. Flange 1816 contains three notches 1822 located to align with protrusions or keys 1904 of keyway 1818 when push-to-lock fitting 1810 is rotated to a "release" position.

Figure 22B:
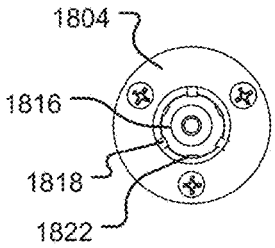
FIGS. 22 and 23 show views of a support post and tensioning cartridge, in accordance with various representative embodiments.
Figure 22A:
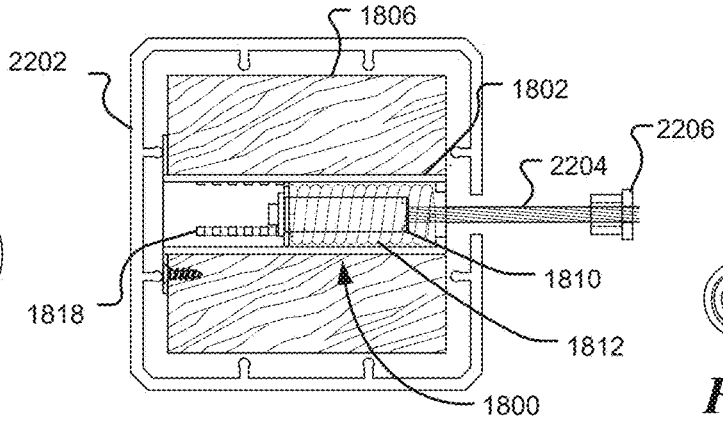
Figure 22C:
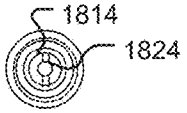
Figure 23B:
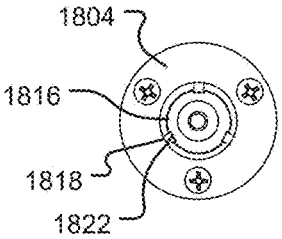
Figure 23A:
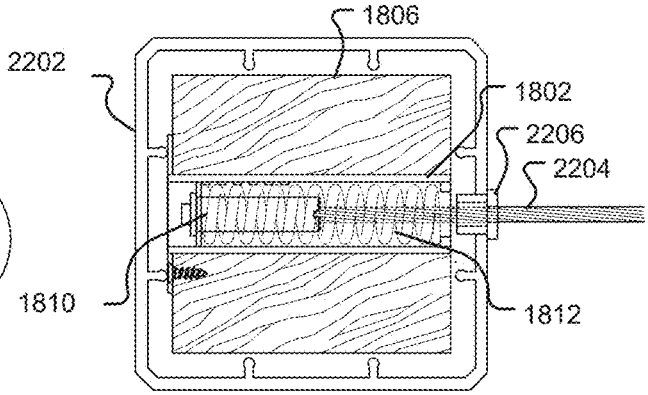
Figure 23C:
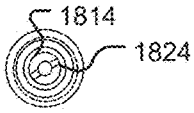
Figure 24D:
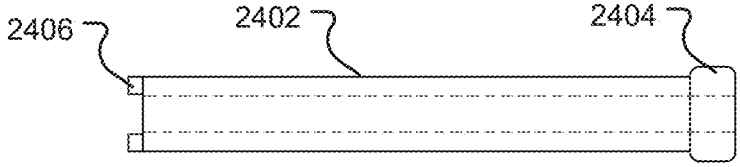
FIG. 24 shows orthographic views of a cable railing spanner, in accordance with various representative embodiments.
Figure 24B:
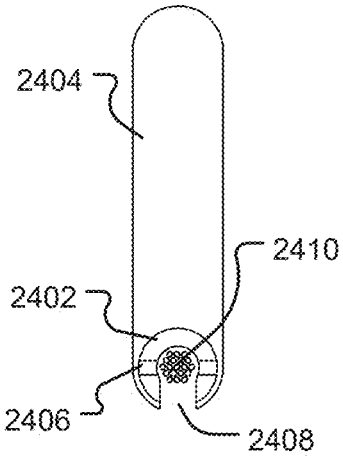
Figure 24A:
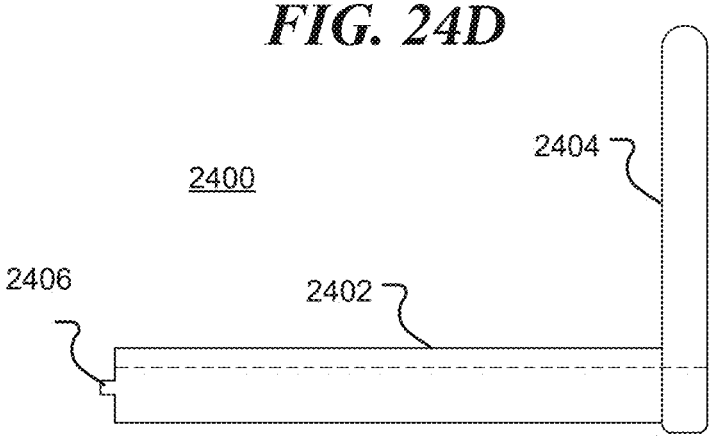
Figure 24C:
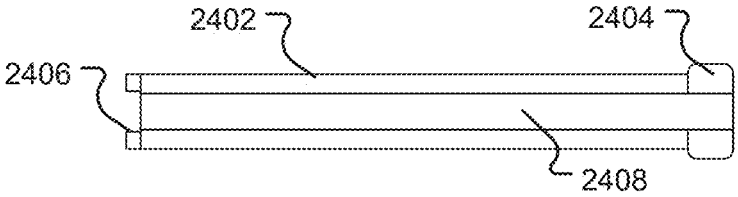

FIGS. 22 and 23 show views of support post 1806 with tensioning cartridge 1800, in accordance with an embodiment of the present disclosure. In view "A" of FIG. 22, tensioning cartridge 1800 is loaded, so spring 1812 is compressed and push-to-lock fitting 1810 is rotated so that notches 1822 in flange 1816 are not aligned with protrusions or keys 1904 of keyway 1818, as shown in view "B". During installation of the cable railing system, inner support post 1806 is mounted and then decorative sleeve 2202 is placed over inner support post 1806. Next, an end portion of cable 2204 is inserted into push-to-lock fitting 1810. Grommet 2206 is placed around cable and the other end of cable 2204 is attached to another support post. The push-to-lock fitting 1810 is then rotated to align notches 1822 with protrusions or keys 1904 of keyway 1818. This releases spring 1812 and tensions cable 2204, as shown in FIG. 23.

In view "A" of FIG. 23, spring 1812 is released and push-to-lock fitting 1810 is pushed along tube 1802, thereby applying tension to cable 2204. Grommet 2206 is moved into the opening in sleeve 2202. View "B" shows how notches 1822 are aligned with protrusions or keys 1904 of keyway 1818. View "C" shows how push-to-lock fitting 1810 has been rotated using slots 1824.

FIG. 24 shows orthographic views of a cable railing spanner 2400, in accordance with an embodiment of the present disclosure. FIG. 24 shows side view "A", end view "B", bottom view "C" and top view "D". Cable railing spanner 2400 includes shaft 2402 and handle 2404. Spanner tips 2406 are shaped to engage with a corresponding slot in the end of a push-to-lock fitting, such as, for example, push-to-lock fitting 1810. Shaft 2402 is rotated using handle 2404 to lock or release a tensioning cartridge, such as, for example, tensioning cartridge 1800. For example, spanner 2400 may compress spring 1812 by pressing push-to-lock fitting 1810 while the keys and notches are aligned, and then lock spring 1812 in place by rotating push-to-lock fitting 1810. Spanner 2400 includes a slot 2408, shown in views "B" and "C", which enables spanner 2400 to be used when cable 2410 (shown in view "B") is secured in push-to-lock fitting 1810. Slot 2408 is sized to accommodate cable 2410.

It will be apparent to those of skill in the art that other rotate-to-lock/rotate-to-release mechanisms may be used without departing from the present disclosure. For example, the push-to-lock fitting may have a thread on its outer surface that can engage with a short length of thread on the inner surface of the tube. The threads may be engaged or disengaged by rotating the push-to-lock fitting. Moreover, it will be appreciated that there are various ways to tension a cable once engaged into the push-to-lock fitting. By way of example and not limitation, these include threads, screws, pins (pushing and/or pulling), springs, sleeves, spacers that spin and allow the fitting to stay in place.

In this document, relational terms such as first and second, top and bottom, and the like may be used solely to distinguish one entity or action from another entity or action without necessarily requiring or implying any actual such relationship or order between such entities or actions. The terms "comprises," "comprising," "includes," "including," "has," "having," or any other variations thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises . . . a" does not, without more constraints, preclude the existence of additional identical elements in the process, method, article, or apparatus that comprises the element.

Reference throughout this document to "one embodiment," "certain embodiments," "an embodiment," "implementation(s)," "aspect(s)," or similar terms means that a particular feature, structure, or characteristic described in connection with the embodiment is included in at least one embodiment of the present disclosure. Thus, the appearances of such phrases or in various places throughout this specification are not necessarily all referring to the same embodiment. Furthermore, the particular features, structures, or characteristics may be combined in any suitable manner in one or more embodiments without limitation.

The term "or", as used herein, is to be interpreted as an inclusive or meaning any one or any combination. Therefore, "A, B or C" means "any of the following: A; B; C; A and B; A and C; B and C; A, B and C". An exception to this definition will occur only when a combination of elements, functions, steps or acts are in some way inherently mutually exclusive.

As used herein, the term "configured to", when applied to an element, means that the element may be designed or constructed to perform a designated function, or that is has the required structure to enable it to be reconfigured or adapted to perform that function.

Numerous details have been set forth to provide an understanding of the embodiments described herein. The embodiments may be practiced without these details. In other instances, well-known methods, procedures, and components have not been described in detail to avoid obscuring the embodiments described. The disclosure is not to be considered as limited to the scope of the embodiments described herein.

The various representative embodiments, which have been described in detail herein, have been presented by way of example and not by way of limitation. It will be understood by those skilled in the art that various changes may be made in the form and details of the described embodiments resulting in equivalent embodiments that remain within the scope of the appended claims.

What is claimed is:

1. A method, comprising:

loading a tensioning cartridge including a tube, a push-to-lock fitting and a spring, including:

compressing the spring between a spring stop of the tube and a flange of the push-to-lock fitting, and engaging a spring-lock mechanism to hold the spring in compression;

placing the tensioning cartridge in a support post of a cable railing system;

placing a decorative cover over the support post;

inserting an end region of a cable of the cable railing system into the push-to-lock fitting; and releasing the spring-lock mechanism to release the spring and tension the cable.

2. A method, comprising:

placing a tensioning cartridge in a support post of a cable railing system, the tensioning cartridge including a tube, a push-to-lock fitting and a spring;

loading the tensioning cartridge, including:

compressing the spring between a spring stop of the tube and a flange of the push-to-lock fitting, and engaging a spring-lock mechanism to hold the spring in compression;

placing a decorative cover over the support post;

inserting an end region of a cable of the cable railing system into the push-to-lock fitting; and releasing the spring-lock mechanism to release the spring and tension the cable self-tension cables with springs of different strengths for local codes and/or while other tightening methods are engaged.

* * * * *